US005893375A

United States Patent [19]

Majors

[11] Patent Number: 5,893,375

[45] Date of Patent: Apr. 13, 1999

[54] THUMB TAB REPLACEMENT SLEEVE IN COMBINATION WITH A HAIR STYLING APPLIANCE

[76] Inventor: Timothy R. Majors, 8200 Harmon Dr., Wichita, Kans. 67210

[21] Appl. No.: 08/883,236

[22] Filed: Jun. 26, 1997

Related U.S. Application Data

[60] Provisional application No. 60/022,260, Jul. 19, 1996.

[51] Int. Cl.[6] ..... A45D 1/04

[52] U.S. Cl. ..... 132/232; 74/558; 74/558.5; 219/225

[58] Field of Search ..... 132/232, 263, 132/234, 229, 269; 16/114 R, 116 R; 74/558, 558.5; 219/225, 226, 227, 228, 229, 230; 150/155, 161, 901; 2/17, 20, 21

[56] References Cited

U.S. PATENT DOCUMENTS

| | | | |
|---|---|---|---|
| 1,712,675 | 5/1929 | Olsen | 16/116 R |
| 2,520,808 | 8/1950 | Miller | 16/116 R |
| 2,905,946 | 9/1959 | Goldsmith | 2/17 |
| 4,944,437 | 7/1990 | Calvert | 2/21 |
| 5,347,684 | 9/1994 | Jackson | 16/114 R |
| 5,511,445 | 4/1996 | Hildebrandt | 74/558.5 |

*Primary Examiner*—Todd E. Manahan
*Assistant Examiner*—Eduardo C. Robert
*Attorney, Agent, or Firm*—Richard C. Litman

[57] ABSTRACT

A replacement sleeve for a heat insulative thumb tab that fits over a lever on a heated tool such as a hair curling iron. The replacement sleeve is preferably constructed of three parts: a base layer, a patch layer, and an insert layer. The base layer is an elongate strip of material, preferably made from leather. The patch layer is preferably made from a soft leather, such as suede. The insert layer is preferably made of a resilient type of material, such as cotton. The elongate strip of material is folded about a transverse fold line which separates the base layer into an upper portion and a lower portion. The lower portion is secured to one side of the upper portion to define a channel therebetween. Secured to the opposite side of the base layer upper portion are the intermediate layer and the upper layer. The assembled sleeve is sized and configured for insertion of a curling iron lever into the channel, such that all three layers provide the user with protection against heat retained by the lever.

3 Claims, 2 Drawing Sheets

THUMB TAB REPLACEMENT SLEEVE IN COMBINATION WITH A HAIR STYLING APPLIANCE

CROSS-REFERENCE TO RELATED APPLICATION

This application claims the benefit of U.S. Provisional Patent Application Serial No. 60/022,260, filed Jul. 19, 1996.

BACKGROUND OF THE INVENTION

1. Field of the Invention

The present invention relates generally to a hair styling appliance. More specifically, the invention is a padded leather sleeve adapted for use as an insulator for the clamp lever of a curling iron. This sleeve of the present invention replaces a thumb tab that has been damaged or lost, for continued use of the appliance without risk of burn injuries.

2. Description of Related Art

Hair curling irons typically have a cover which can be lifted off a heating element by pushing a lever. For example, FIG. 3 shows a typical hair curling iron 10. The hair curling iron 10 has a handle 12 with a source for power 12A. Extending from the handle 12 is a barrel 14 containing a heating element (not shown) Adjacent barrel 14 is a clamping member 16 that holds the hair as the curling iron 12 is turned. The clamping member 16 has a pivot point on the barrel 14 in close proximity to the handle 12. At the pivot point, an arm 14A is attached, arm 14A allows the curling iron 10 to rest atop a surface with the heated barrel 14 raised above the surface. Also, extending from the clamping member 16 is a lever 18. Lever 18 allows the user to manipulate the clamping member 16 about the barrel 14. The lever 18 is generally controlled by the thumb or forefinger of the user. As the lever 18 becomes heated by the conduction of heat, a heat insulating tab 20 is generally provided to prevent the thumb or forefinger of the user from being burned. Often, heat insulating tab 20 becomes damaged or broken (as illustrated in FIG. 3), rendering the curling iron 10 virtually useless. The lifespan of the curling iron 10 may be effectively increased by providing a means for replacing a damaged or broken heat insulating tab 20. Therefore, a need exists for a convenient way of replacing the heat insulating tab 20. The instant invention solves this problem by providing a heat-insulating sleeve that easily fits over the lever of a curling iron.

U.S. Pat. No. 4,101,756, issued on Jul. 18, 1978, to Jiichi Yamano, discloses an electrically heated curling iron and a stand therefor, including a thermal insulating handle, but does not disclose any means for replacing a broken thumb tab.

U.S. Pat. No. 4,308,878, issued on Jan. 5, 1982, to Wilbur W. Silva, discloses a curling iron holder with a thumb lever, but does not disclose any replaceable means of covering the thumb lever.

U.S. Pat. No. 4,581,519, issued on Apr. 8, 1986, to Arnold Thaler, David Friedson, and Lai Kin, discloses a flocked curling iron with a projection that terminates in a molded piece with a depression for receiving the user's thumb. The instant invention is distinguishable in that it discloses a replaceable cover for a part pushed by the user's thumb.

U.S. Pat. No. 4,866,249, issued on Sep. 12, 1989, to Charles W. Howard, discloses a safety device for hair curling heating irons which prevents burns. The safety device includes spaced non-heat conductive ribs which surround the barrel and clamping member. The curling iron itself contains a thumb tab at the end of the lever, but it does not disclose any means of replacing the thumb tab.

U.S. Pat. No. 4,877,942, issued on Oct. 31, 1989, to John J. Raab, discloses a thermally-insulated curling iron with a pivoted spoon having an extension with a thumb button. The curling iron of Raab does not disclose any sleeve covering the thumb button.

U.S. Pat. No. 5,354,967, issued on Oct. 11, 1994, to Yinon Barzilai, William Levy, and Robert Sherwood, discloses a hair styling appliance heater and control, having a heat insulated handle with a cool tip.

Swiss Patent No. 452,728, published on May 31, 1968, to Ingeburg Kohl, discloses a curling iron with a lever having a cap, but does not disclose a replaceable covering for the lever.

British Patent No. 2,022,406, published on Dec. 19, 1979, inventor Henri Smal, discloses an appliance, in particular a heated hair brush, with a disengageable handle.

British Patent No. 2,065,471, published Jul. 1, 1981, inventor Annibale (Nino) Suda, discloses electrical hair-waving tongs with a heat-insulated tong grips.

None of the above inventions and patents, taken either singly or in combination, is seen to describe the instant invention as claimed.

SUMMARY OF THE INVENTION

A replacement sleeve for a thumb tab that fits over a lever on a heated tool, such as a hair curling iron, to prevent the user's finger from being burned. It may also reduce chafing from friction. The replacement sleeve is fabricated from three parts: a base member, an upper layer, and an intermediate layer. The base member and upper layer are preferably made from leather, and the intermediate layer is preferably made from cotton. Alternatively, any suitable materials may be used to make any of the three parts. To assemble the invention, the intermediate layer is placed between the base member and the upper layer, and the three parts are sewn together. Simultaneous with or prior to the securing together of the three parts, the base member is folded along a transverse fold into an upper portion and a lower portion. The intermediate layer and upper layer are secured to the upper portion, while the lower portion is secured to the opposite side of the upper portion to define a channel or pocket into which the lever of a curling iron or similar tool can be inserted. The upper portion further includes a rounded end which extends beyond the lower portion after they are sewn together, and also beyond where the upper layer and the intermediate layer are secured on the upper portion.

Accordingly, it is a principal object of the invention to provide a means for replacing a broken or lost thumb tab on a curling iron or similar tool.

It is another object of the invention to provide a sleeve that may serve as a thumb tab on tools that were not originally equipped with thumb tabs.

It is a further object of the invention to provide a means for preventing burns to the fingers of users of heating tools.

Still another object of the invention is to provide a means for preventing chafing of fingers on frequently used levers.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
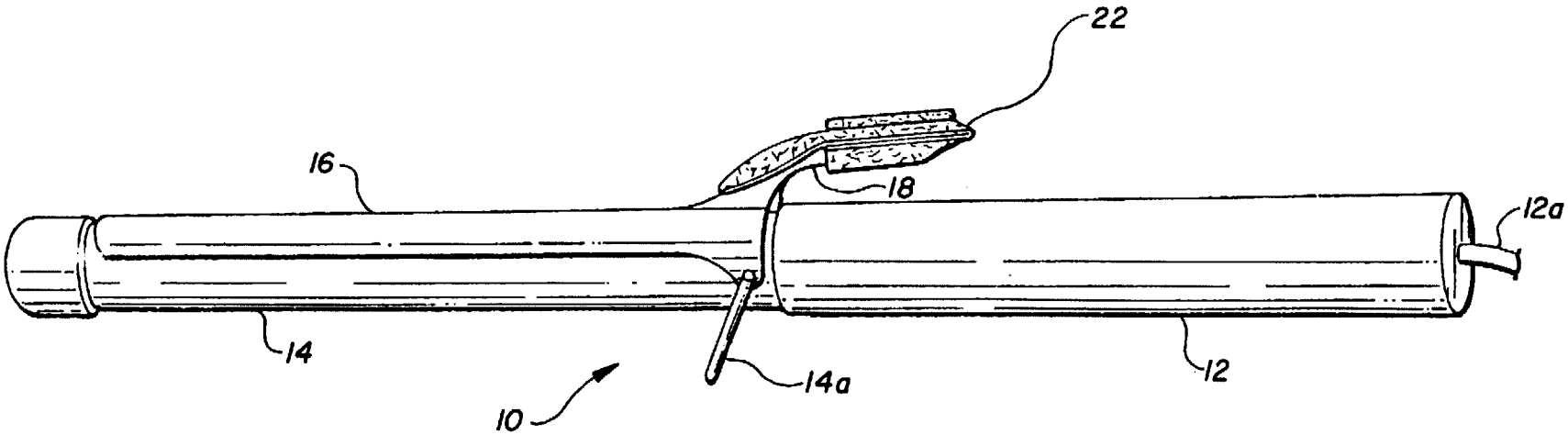
FIG. 1 is a perspective view showing the thumb tab replacement sleeve of the present invention on a curling iron.
Figure 3:
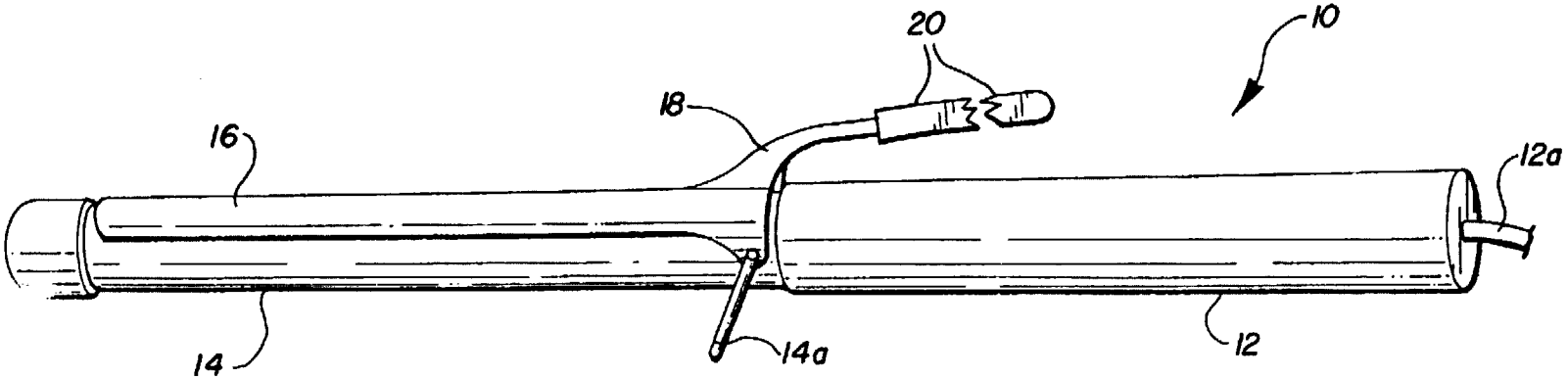
FIG. 3 (PRIOR ART)
FIG. 3 is a perspective view showing a broken tab removed from a curling iron of the prior art.

Referring to FIG. 1, a curling iron 10 is shown including a replacement sleeve 22 of the present invention. The curling iron 10, as shown in FIG. 3 and described above, includes the clamping member 16 which can be lifted off the heated barrel 14 by pushing the lever 18. The replacement sleeve 22 of the present invention is disposed for replacement of the thumb tab 20 on the end of the lever 18 to prevent the thumb or forefinger of the user from being burned. The invention also reduces the chafing that results from friction.

As the lever 18 becomes heated by the conduction of heat, absence of the thumb tab 20 (i.e., damaged, broken, or missing) may result in the thumb or forefinger of the user being burned, possibly severely. On the other hand, the loss of the tab 20 renders the curling iron 10 virtually useless. Thus, the lifespan of the curling iron 10 may be effectively increased by the providing of the replacement sleeve 22. The replacement sleeve 22 provides an adequate and suitable form of heat insulation and comfort.

Figure 2:
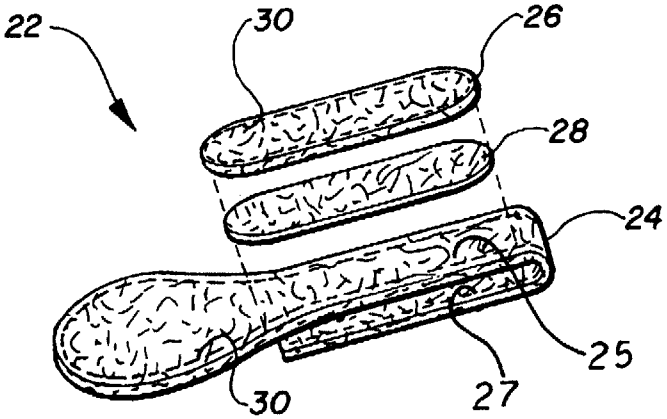
FIG. 2 is an exploded perspective view of the invention.

Referring now to FIG. 2, replacement sleeve 22 is constructed from three distinct layers. The replacement sleeve 22 includes a base member 24 that is formed of an elongated strip of material possessing a good heat resistive index, preferably leather. The base member 24 has a transverse fold which separates the base member into an upper portion 25 and a lower portion 27. The side edges of the upper portion and lower portion are sewn or otherwise secured together as described hereinafter, thereby forming a channel into which the lever 18 is insertable. The base member 24 forms the lower or base layer of the replacement sleeve 22. Secured to the upper portion 25 of the base member are an intermediate layer 28 and an upper layer 26. The upper layer 26 of the replacement sleeve is a patch of material, also having a good heat resistive index, preferably leather. The patch of material 26 has a general size and conformity of that of an average thumb or forefinger. Between the upper layer and the base member 24 is the intermediate layer of padding material 28 having resilient characteristics, preferably a fibrous woven or non-woven material such as cotton. The patch of material 26, padding material 28, and base member 24 are secured together along a stitched seam 30. The stitch seam 30 also forms the channel between the upper and lower portions of the base member 24.

The curling iron 10 has an increase in the effective lifespan due the provision of the replacement sleeve 22. The user is able to continue using the curling iron 10 after the heat insulating tab 20 has been damaged, broken, or lost by substituting the replacement sleeve 22 therefor. Although the materials have been preferably set forth, it is apparent that base member 24 may be substituted with any other suitable heat resistive material, such as ceramic, etc. Likewise, the patch of material 26 may be substituted with a softer or more comfortable material, such as suede, velvet, vellum, etc. In addition, the padding layer 28 may be substituted with an appropriate resilient material, such as polyfoam, rubber, etc. Finally, the stitched seam 30 may be substituted by any other type of securing means, such as adhesive, etc.

It is to be understood that the present invention is not limited to the sole embodiment described above, but encompasses any and all embodiments within the scope of the following claims.

I claim:

1. A replacement sleeve for a heat insulative thumb tab in combination with a hair styling appliance having a handle, a heating barrel extending from the handle, and a clamping member with a lever pivotally connected to the heating barrel, said replacement sleeve comprising:

a base layer including an elongated strip of leather material having side edges and a transverse fold separating said base layer into an upper portion and a lower portion, said lower portion being secured to said upper portion along the side edges to define a channel therebetween, said channel being sized and configured for placement onto the lever of the hair styling appliance;

an intermediate layer formed of a resilient padding material, said intermediate layer being disposed adjacent said upper portion of said base layer; and an upper layer of leather material having a periphery, said upper layer being disposed adjacent said intermediate layer and being secured along said periphery to the upper portion of the base layer.

2. The combination according to claim 1, wherein said upper layer of the replacement sleeve is secured along its periphery to the upper portion of the base layer by a stitch seam.

3. The combination according to claim 1, wherein said resilient material of the replacement sleeve is cotton.

* * * * *